US006616546B2

(12) United States Patent
Cho

(10) Patent No.: US 6,616,546 B2
(45) Date of Patent: Sep. 9, 2003

(54) GOLF CLUB HEAD

(76) Inventor: Jung Hyun Cho, 643-23 Deungchon-Dong, 2nd Floor, GangSeo-Gu Seoul 157-031 (KR)

( * ) Notice: Subject to any disclaimer, the term of this patent is extended or adjusted under 35 U.S.C. 154(b) by 0 days.

(21) Appl. No.: 09/768,543

(22) Filed: Jan. 25, 2001

(65) Prior Publication Data

US 2002/0098909 A1 Jul. 25, 2002

(51) Int. Cl.[7] ..... A63B 53/04

(52) U.S. Cl. ..... 473/329; 473/332; 473/342; 473/350

(58) Field of Search ..... 473/324, 325, 473/326, 327, 328, 329, 332, 342, 345, 349, 346, 350, 290, 291

(56) References Cited

U.S. PATENT DOCUMENTS 4,398,965 A * 8/1983 Campau
5,509,660 A * 4/1996 Elmer
5,649,872 A * 7/1997 Antonious
5,697,855 A * 12/1997 Aizawa
5,993,331 A * 11/1999 Shieh
6,045,456 A * 4/2000 Best

* cited by examiner

*Primary Examiner*—Sebastiano Passaniti
(74) *Attorney, Agent, or Firm*—Myron Amer P.C.

(57) ABSTRACT

Disclosed is a golf club head, which comprises a hosel for receiving a golf club shaft, a club head body having a heel and toe, the club head body being hollowed rearwards to form an attachment opening, a weight protuberance jutting out from the part of the attachment opening near the toe to optimize the weight center of the club head body, a separate ball striking plate tightly fitted into the attachment opening, a shock absorption part consisting of a plurality of concentric circular steps cut in the rear surface of the ball striking plate, and a connection opening formed in the ball striking plate so as to grasp the weight protuberance when fitting the ball striking plate into the attachment opening, whereby the ball striking plate resiliently absorbs the impact of striking a golf ball, and the weight protuberance shifts the weight center from the heel to the toe.

3 Claims, 4 Drawing Sheets

GOLF CLUB HEAD

BACKGROUND OF THE INVENTION

1. Field of the Invention

The present invention relates to a golf club generally consisting of a grip, shaft, and head, and more particularly to a golf club head having an improved ball striking plate and a weight to stabilize its swing.

2. Description of the Related Art

There are used various kinds of golf clubs such as a wood, iron, putter, etc. according to the targeted distance to send the ball. When playing a golf game, one of the most important things critically serving to win the game is to make a first shot to send the ball as near to the intended target as possible. Accordingly, there have been many attempts to achieve a golf club head to improve both shot and ball-flight distance by proposing various materials and structures for the head. For example, a metal is used for the wood club, or the rear surface of the head is depressed.

However, such conventional attempts are mostly devoted to simply improve the ball-flight distance or increase the ball striking face of the head, but can hardly contribute to the training of an inexpert golfer. Namely, the conventional golf clubs depend only on the golfer's feel to control the slice or hook, so that it is very difficult for the inexpert golfer to control the ball or striking feel.

Korean Patent No. 99-0215992 granted to the present applicant discloses a golf club head consisting of a front ball striking surface and rear surface integrally formed with the club head body in order to improve the ball-flight distance and striking feel. This head is characterized in that the rear surface is undercut forming a plurality of concentric circular steps, which absorb the impact of the ball-striking surface struck by the ball so that their resilient force may increase the ball-flight distance. Namely, when striking the ball, the club head is resiliently bent rearwards with the help of the concentric circular steps cut in the rear surface, so that the vibrations and impact imparted to the head are absorbed, and then its resilient force may improve the ball-flight distance. Accordingly, this also enhances the striking feel of the golfer.

However, this structure also has the weight center towards the heel, causing the inexpert golfer to make the open swing, as in the conventional golf club, so that it is hardly possible to make a correct shot, and an unexpected slice may occur. Additionally, it is not easy to correctly undercut the rear surface of the club head to form the concentric circular steps. Moreover, the weight center located backward of the head makes the inexpert golfer hardly control his position especially when making a long-distance shot. This requires him to be hard trained to control the golf club.

SUMMARY OF THE INVENTION

It is an object of the present invention to provide an improved golf club head with means for improving both ball-flight distance and striking feel.

It is another object of the present invention to provide an improved golf club head with means for enabling the inexpert to easily obtain the striking feel.

It is still another object of the present invention to provide an improved golf club with means for shifting the weight center of the club head body from the heel to toe to increase the moment of inertia of the head, so that the ball-flight distance may be considerably increased, and the inexpert may make a correct shot without falling into the open swing.

According to an aspect of the present invention, a golf club head comprises a hosel for receiving a golf club shaft, a club head body having a heel and toe, the club head body being hollowed rearwards to form an attachment opening, a weight protuberance jutting out from the part of the attachment opening near the toe to optimize the weight center of the club head body, a separate ball striking plate tightly fitted into the attachment opening, a shock absorption part consisting of a plurality of concentric circular steps cut in the rear surface of the ball striking plate, and a connection opening formed in the ball striking plate so as to grasp the weight protuberance when fitting the ball striking plate into the attachment opening, whereby the ball striking plate resiliently absorbs the impact of striking a golf ball, and the weight protuberance shifts the weight center from the heel to the toe.

According to another aspect of the present invention, the shock absorption part consists of a plurality of concentric elliptical grooves formed in the rear surface of said ball striking plate. Or otherwise, the shape of the steps or grooves constituting the shock absorption part may be rectangular or square.

The present invention will now be described more specifically with reference to the drawings attached only by way of example.

BRIEF DESCRIPTION OF THE ATTACHED DRAWINGS

DETAILED DESCRIPTION OF THE PREFERRED EMBODIMENT

Figure 1:
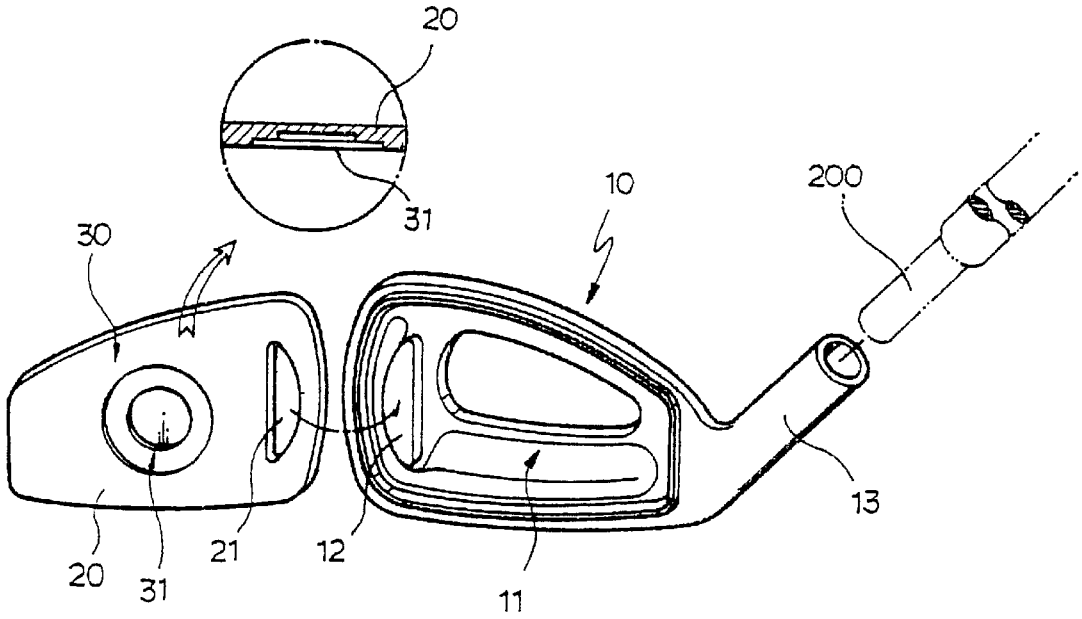
FIG. 1 is an exploded perspective view for illustrating a golf club head according to an embodiment of the present invention.
Figure 2A:
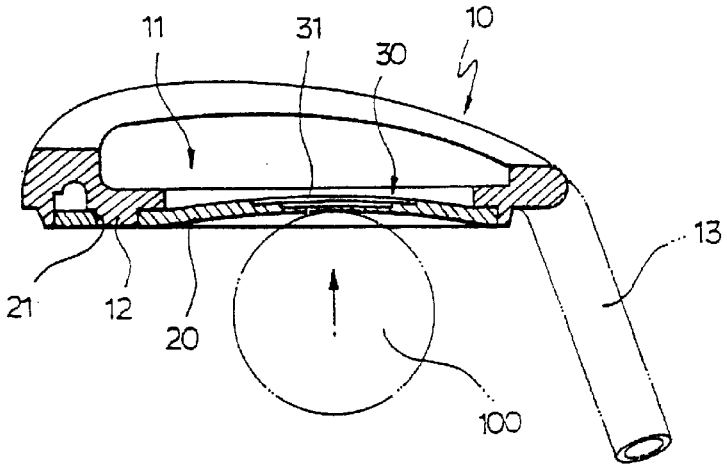
FIGS. 2A and 2B are horizontal cross sectional views of FIG. 1 respectively illustrating the shock absorption part of the ball striking plate resiliently bent backwards and forwards when striking the ball.
Figure 2B:
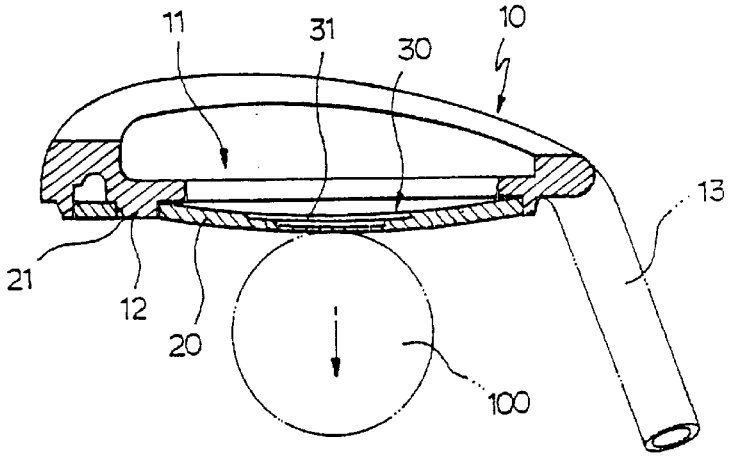
Figure 3:
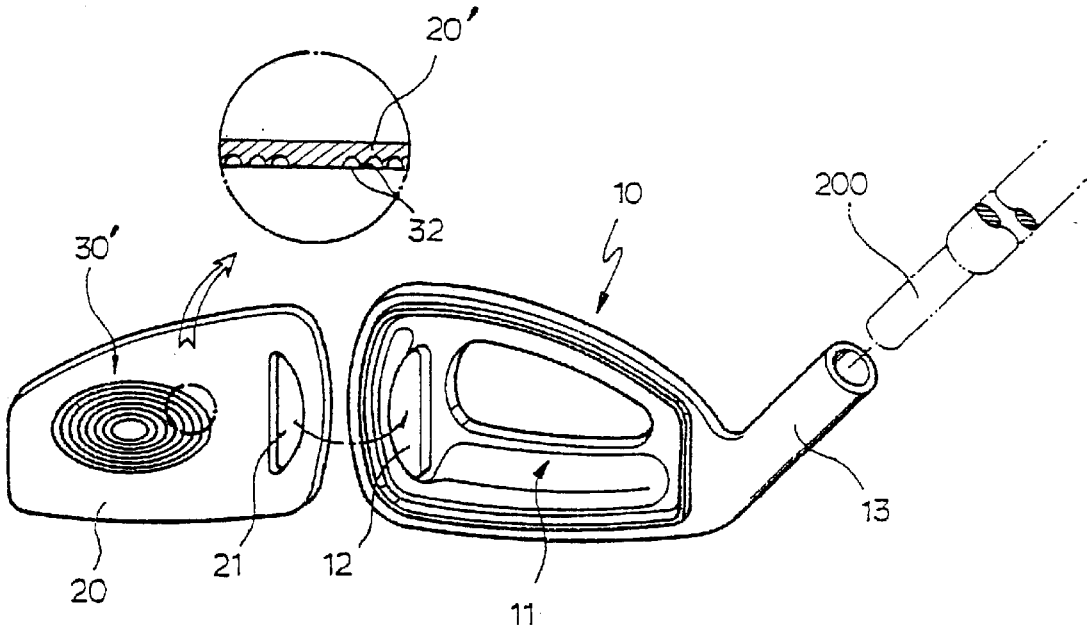
FIG. 3 is a view similar to FIG. 1 but with the shock absorption part modified differently according to another embodiment of the present invention.
Figure 4A:
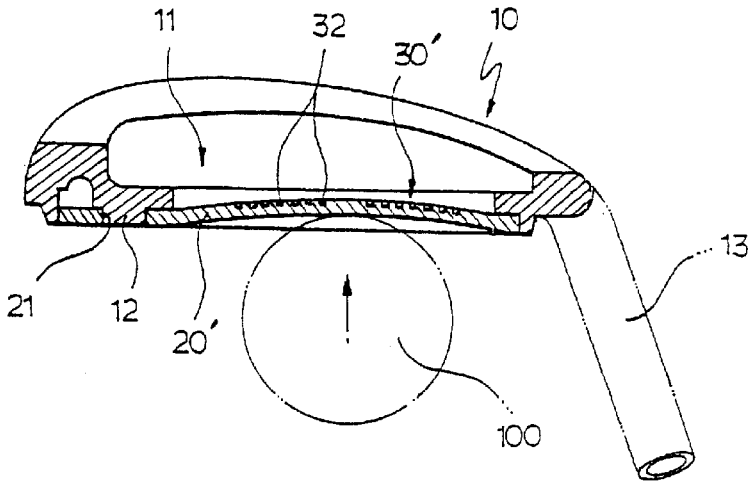
FIGS. 4A and 4B are horizontal cross sectional views of FIG. 3 respectively similar to FIGS. 2A and 2B.
Figure 4B:
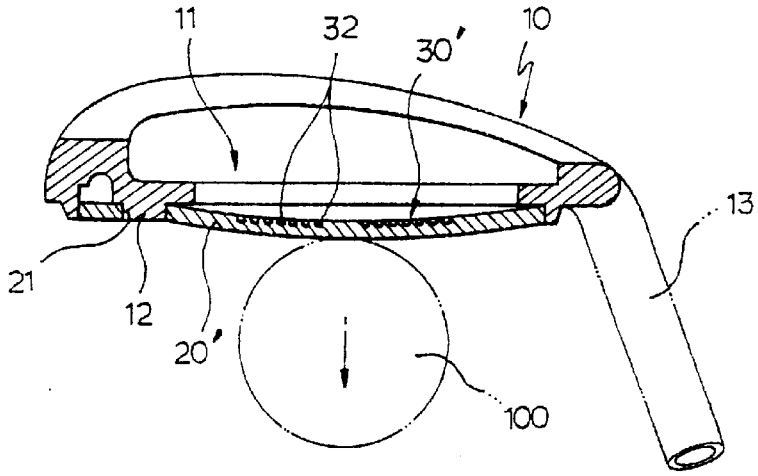

Referring to FIGS. 1 to 2B, a golf club head includes a hosel 13 for receiving a golf club shaft 200, and a club head body 10 having a heel and toe. The club head body 10 is hollowed rearwards to form an attachment opening 11. A weight protuberance 12 juts out from the part of the attachment opening 11 near the toe to optimize the weight center of the club head body 10. A separate ball striking plate is tightly fitted into the attachment opening 11. A shock absorption part 30 consists of a plurality of concentric circular steps 31 cut in the rear surface of the ball striking plate 20. A connection opening 21 is formed in the ball striking plate 20 so as to grasp the weight protuberance 12 when fitting the ball striking plate into the attachment opening 11. As shown in FIGS. 3 to 4B, the shock absorption part 30 may consist of a plurality of concentric elliptical grooves 32 formed in the rear surface of the ball striking plate 20. In addition, the shape of the steps 31 or grooves 32 may be square or rectangular. Reference numeral 100 represents a golf ball.

As shown in the drawings, since the ball striking plate 20 is formed separately from the club head body 10, it is easy to cut its rear surface to correctly form the concentric circular steps 31. The diameters of the concentric circular steps 31 are sequentially increased upward, so that the shock absorption part 30 struck by the golf ball 100 is first resiliently bent inward of the attachment opening 11, and then the recuperating resilient force adds to the thrust of the golf ball 100 applied by the golfer's swing, thus significantly increasing the ball-flight distance.

The weight protuberance 12 jutting out near the toe and tightly fitted into the connection opening 21 of the ball striking plate 20 shifts the weight center of the club head body 10 towards the toe, so that the moment of inertia of the club head body is increased, and thus the speed of swinging the head, effectively increasing the ball-flight distance. Furthermore, this structure serves to effectively prevent both the slice and the side spinning due to the open swing that results in pivoting of the club head body 10 forwards or backwards with respect to the golfer's body.

Compared to this, the structure of the conventional golf club head body 10 has the weight center towards the heel, causing the inexpert golfer to make the open swing, so that the inexpert can hardly make a correct shot, and an unexpected slice may occur. Moreover, the weight center located backward of the head makes the inexpert golfer hardly control his position especially when making a long-distance shot. This requires him to be hard trained to control the golf club.

Referring to another embodiment of FIGS. 3 to 4B, the shock absorption part 30' consists of a plurality of concentric elliptical grooves 32 formed in the rear surface of the ball striking plate 20', instead of the concentric circular steps of the previous embodiment. Likewise, it is resiliently bent rearwards to effectively absorb the impact of striking the golf ball 100, thus reducing the impact applied to the golfer's body, and then its recuperating resilient force adds to the ball-flight distance. This also absorbs the vibrations produced by the impact of the golf ball 100 to stabilize the intended ball-flight direction. In addition, this effectively distributes the stress applied to the ball striking plate 20', so that the inexpert may readily obtain the striking feel through the damped vibrations transferred from the head to the grip. Moreover, the simple structure of the shock absorption part 30' as shown in the present embodiment is easily obtained through simple cutting, compared to that 30 of the previous embodiment. Of course, the shape of the grooves 32 may take various forms such as circles, squares, rectangles, etc.

Thus, the inventive arrangement combining the shock absorption part 30, 30' and the weight protuberance 12 enables the inexpert both to stably make a long distance shot and to readily obtain the striking feel. While the present invention has been described in connection with specific embodiments accompanied by the attached drawings, it will be readily apparent to those skilled in the art that various changes and modifications may be made thereto without departing the gist of the present invention.

What is claimed is:

1. A golf club head comprising:

a hosel for receiving a golf club shaft;

a club head body having a heel and toe, said club head body being hollowed rearwards to form an attachment opening;

a weight protuberance jutting out from the part of said attachment opening near said toe to optimize the weight center of said club head body;

a separate ball striking plate tightly fitted into said attachment opening;

a shock absorption part consisting of a plurality of concentric circular steps cut in the rear surface of said ball striking plate; and a connection opening formed in said ball striking plate so as to grasp said weight protuberance when fitting said ball striking plate into said attachment opening, whereby said ball striking plate resiliently absorbs the impact of striking a golf ball, and said weight protuberance shifts the weight center from said heel to said toe.

2. A golf club head as defined in claim 1, wherein said shock absorption part consists of a plurality of concentric elliptical grooves formed in the rear surface of said ball striking plate.

3. A golf club head as defined in claim 1 or 2, wherein the shape of the steps or grooves constituting the shock absorption part is square or rectangular.

* * * * *